US011280548B2

(12) United States Patent
Marcuzzi et al.

(10) Patent No.: US 11,280,548 B2
(45) Date of Patent: Mar. 22, 2022

(54) APPARATUS FOR THE PRODUCTION OF METAL

(71) Applicant: MORE S.r.l., Gemona del Friuli (IT)

(72) Inventors: Simone Marcuzzi, Artegna (IT); Stefano Morsut, Udine (IT)

(73) Assignee: MORE S.R.L., Gemona del Friuli (IT)

( * ) Notice: Subject to any disclaimer, the term of this patent is extended or adjusted under 35 U.S.C. 154(b) by 96 days.

(21) Appl. No.: 16/740,981

(22) Filed: Jan. 13, 2020

(65) Prior Publication Data

US 2020/0149817 A1 May 14, 2020

(30) Foreign Application Priority Data

Dec. 23, 2019 (IT) ..... 102019000025234

(51) Int. Cl.

| | |
|---|---|
| ***F27B 14/08*** | (2006.01) |
| ***F27B 14/06*** | (2006.01) |
| ***F27B 14/12*** | (2006.01) |
| ***F27D 3/15*** | (2006.01) |

(52) U.S. Cl.

CPC ..... *F27B 14/0806* (2013.01); *F27B 14/06* (2013.01); *F27B 14/12* (2013.01); *F27D 3/1518* (2013.01); *F27B 2014/0818* (2013.01)

(58) Field of Classification Search

CPC ..... F27B 14/06; F27B 14/0806; F27B 14/12; F27B 2014/0818; F27D 3/1518

USPC ..... 266/45, 272, 44

See application file for complete search history.

(56) References Cited

U.S. PATENT DOCUMENTS

| | | | | |
|---|---|---|---|---|
| 4,736,930 | A * | 4/1988 | Weber | B22D 41/14 222/597 |
| 5,914,087 | A * | 6/1999 | Fuchs | B22D 41/46 266/45 |
| 9,920,995 | B2 * | 3/2018 | Longo | F27D 3/1536 |
| 2013/0320601 | A1 | 12/2013 | Kephart et al. | |

FOREIGN PATENT DOCUMENTS

| | | | | |
|---|---|---|---|---|
| KR | 101330306 | B1 | 11/2013 | |
| KR | 20130122112 | * | 11/2013 | F27D 3/1536 |

* cited by examiner

*Primary Examiner* — Jessee R Roe
*Assistant Examiner* — Michael Aboagye
(74) *Attorney, Agent, or Firm* — Panitch Schwarze Belisario & Nadel LLP

(57) ABSTRACT

Apparatus for the production of metal including a furnace for melting metal provided with a crucible inside which a metal charge is melted. The furnace provides for tapping a liquid metal disposed on the bottom of the crucible and includes a tapping channel for the transfer of the liquid metal from the furnace. The apparatus also includes a delivery unit for delivering inert material (S) having a delivery device for the selective delivery of the inert material (S) into the tapping channel.

13 Claims, 5 Drawing Sheets

APPARATUS FOR THE PRODUCTION OF METAL

CROSS-REFERENCE TO RELATED APPLICATION

This application claims priority under 35 U.S.C. § 119(b) to Italian Application No. 102019000025234, filed Dec. 23, 2019, the disclosure of which is incorporated herein by reference in its entirety.

FIELD OF THE INVENTION

The present invention concerns an apparatus for the production of metal, comprising a melting furnace and a device for the selective delivery of an inert material, preferably refractory, inside the furnace.

BACKGROUND OF THE INVENTION

Apparatuses for the production of metal material are known which comprise a melting furnace, for example an electric arc furnace, provided with at least one metal receptacle, called the "shell", lined with refractory material, resistant to high temperatures, suitable to accommodate the liquid metal produced by the melting. The whole of the metal receptacle and the refractory lining is called "crucible".

The furnace also comprises a covering vault, or a covering panel, which can have apertures for the passage of the electrodes, which enter the crucible to generate the electric arc, and one or more apertures to extract the fumes. At the bottom or on the side of the crucible there are normally means for tapping the liquid metal.

Solutions are known in which a tapping hole is disposed in a decentralized position with respect to the center of the furnace, known as "Eccentric Bottom Tapping" EBT. To carry out the transfer of the liquid metal from the crucible to the transport container for the subsequent steps of the process, there are means for rotating the furnace which allow its horizontal pivoting in order to facilitate the pouring of the liquid. The tapping channel, from which the liquid metal flows, is opened by acting on the aperture of the mechanical means for closing the tapping hole.

After the step of tapping the liquid metal produced in the cycle, and before the metal charge for the following cycle is introduced into the furnace, the tapping hole is incrementally filled with a determinate quantity of inert material, so as to prevent the liquid metal from flowing to the tapping hole, ruining its mechanical closing means, or from obstruct it.

These operations are almost universally carried out manually by dedicated personnel.

Above the tapping channel of the furnace, a cooled covering plane is made provided with an inspection hole. Once the operations for the transfer of the liquid metal are completed, the furnace is rotated backward. The personnel accesses the covering panel and visually inspects the tapping channel through the aperture of the panel, naturally remaining exposed to the radiation of the heat coming from the furnace and being hit by the gases emitted by the crucible itself. In addition, the covering plane is inclined and often covered by various materials projected there by the melting and charging operations, with multiple risks for the safety of the operators.

If the tapping channel has residues that block access to it, partly or totally, it is necessary to proceed to manually remove the residues. Oxygen injection is often used to melt these residues and create an access to the tapping hole. These operations require, in the known state of the art, access with rather bulky tools and oxygen pipes. For an easy handling of the tools and in order to limit risks for personnel, it is necessary to provide appropriately proportioned maneuvering spaces.

In order to prevent personnel from having to operate manually, devices are known for filling the tapping hole with the inert granular materials as above characterized by high melting temperature.

Typically, these filling devices are stably attached to the covering panel of the eccentric portion (U.S. Pat. No. 9,920,995 B2) or to the vault of the furnace (KR101330306B1) and are integral with the latter during all the operative steps of metal production.

One disadvantage of these devices is that if it is necessary to carry out operations to clean the zone of the crucible and the tapping channel, as described above, with access to the covering panel, there is a greater operational risk for the maintenance personnel, given the bulk and the space constraints imposed by the equipment described in the teachings of the state of the art.

In the event of faults and malfunctions of the installed devices, also due to possible factors external thereto, it is extremely difficult to carry out maintenance and repairs so much so that, almost always, it is necessary to dismantle the device. This causes an increase in maintenance times, complexity in the operations to be performed and a high risk for dedicated personnel.

U.S. Pat. No. 9,920,995 B2 mentioned above describes a system for the delivery of sand into a melting furnace, in which the system is stably attached to the furnace and is substantially integral therewith. The system for the delivery of sand described in U.S. Pat. No. 9,920,995 B2 comprises a tank for storing the sand, an upper panel for closing an aperture defined in the vault of the furnace, and a discharge conveyor acting as a calibrated hole, attached through to the upper panel so as to have a lower end, which extends inside the furnace, and an opposite upper end positioned outside the furnace. The first end of the discharge conveyor can be aligned with the tapping hole so as to allow the delivery of the sand in a targeted and cohesive manner inside the tapping channel.

The storage tank is mobile between a first position, far from the upper end of the discharge conveyor, and a second position adjacent to the lower end of the discharge conveyor in order to deliver a predeterminate amount of sand into the discharge conveyor and therefore inside the tapping hole.

The storage tank is attached to the upper panel and is mobile with respect thereto defining a single unit attached to the covering panel above the tapping channel. This can be a problem if it is necessary to intervene to solve a problem with the furnace or a malfunction of the sand delivery system. Furthermore, the storage tank is structured in order to accommodate a predeterminate volume of sand, on average sufficient to fill the tapping channel. However, it may happen that, in the case of a particularly worn channel, the predeterminate amount of sand is not sufficient to fill the channel and it is necessary to proceed manually, lengthening the process times and increasing the risks for the operator.

Another disadvantage of the system described in U.S. Pat. No. 9,920,995 B2 is that the discharge conveyor, during the step of melting the metal charge, but especially during the step of refining the liquid metal, is subject to occlusions due both to splashes of liquid metal on the internal walls of the discharge conveyor, and also to the slag which can easily solidify in contact with the walls of the discharge conveyor and/or with the adjacent surfaces.

Consequently, almost at every work cycle of the furnace, it is necessary to remove the layer of metal and slag solidified inside the discharge conveyor before proceeding with the introduction of the sand to fill the tapping hole again. This entails both a slowdown in production, and also a very high risk for operators who have to carry out the intervention to restore the correct functionality of the discharge conveyor.

In some known systems, for example in the system described in US 2013/0320601A1, a cleaning punch can be provided driven by means of a remote cylinder, configured to remove the occlusions inside the discharge conveyor, thus eliminating the need for dedicated personnel. However, even this solution does not meet production needs given that, also in this case, other unwanted time losses are introduced. Furthermore, if the punch is not able to perfectly clean the edges of the discharge conveyor, its functionality is nullified, and manual cleaning is necessary.

There is therefore a need to perfect an apparatus for the production of metal which can overcome at least one of the disadvantages of the state of the art.

In particular, one purpose of the present invention is to provide an apparatus for the production of metal which allows to reduce the cycle time of the furnace and above all the cycle time for the delivery of the sand.

Another purpose of the present invention is to provide an apparatus for the production of metal that allows to deliver the correct amount of inert material inside the tapping channel, regardless of the level of wear and/or incrustations of the latter.

It is also a purpose of the present invention to provide an apparatus for the production of metal which allows maintenance personnel to carry out maintenance or restoration operations in an easy, rapid, efficient and safe way.

Another purpose of the present invention is to provide an apparatus for the production of metal which reduces the risk of accumulation and stratification of slag and metal in correspondence with the covering panel.

Another purpose of the present invention is to provide an apparatus for the production of metal which allows safe access for the visual inspection of the tapping channel, as well as allowing an easy introduction of the flow of inert material without it being deflected, along its fall trajectory, far from the tapping channel itself.

Another purpose is to perfect a method for the delivery of an inert material, preferably refractory, into a furnace for the production of metal for the cyclical filling of a tapping channel disposed on the bottom of the furnace.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the invention or variants to the main inventive idea.

In accordance with the above purposes, an apparatus for the production of metal, which overcomes the limits of the state of the art and eliminates the defects present therein, comprises:

a furnace for melting metal provided with a crucible inside which a metal charge is melted and with a covering panel, the furnace being provided with means for tapping a liquid metal disposed on the bottom of the crucible and comprising a tapping channel for the transfer of the liquid metal from the furnace to another receptacle for transport toward the treatments downstream, a unit for delivering inert material, comprising at least one delivery device for the selective delivery of inert material into the tapping channel, a hatch unit disposed on the covering panel, which is disposed above the tapping area, that is above the zone of the bottom of the crucible where the tapping channel is provided, and configured to allow access to the inside of the crucible for the delivery of the inert material.

The unit for delivering inert material comprises support means configured to rotatably support the delivery device, in order to take it at least from an operative condition, in which it faces toward the furnace and is aligned with the hatch unit, to a stand-by or parked condition in which it is disposed outside the bulk of the furnace, and vice versa.

The possibility to free the movement of the delivery unit from the structure of the furnace and from the covering panel makes the system much more flexible and allows to considerably simplify the maintenance operations of both the furnace and also the delivery unit.

In addition, the parts involved in the delivery of the material are less likely to be dirtied or encrusted by splashes or metal particles coming from the inside of the furnace.

The presence of a hatch unit of the horizontally pivoting type, which selectively covers the aperture in the covering panel of the furnace, allows to use the same hatch unit to carry out operations for breaking the slag that forms in the proximity of the aperture, freeing it and facilitating and speeding up the filling cycles.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We will now refer in detail to possible embodiments of the invention, of which one or more examples are shown in the attached drawings. Each example is supplied by way of illustration of the invention and shall not be understood as a limitation thereof. For example, one or more characteristics shown or described insomuch as they are part of one embodiment can be varied or adopted on, or in association with, other embodiments to produce other embodiments. It is understood that the present invention shall include all such modifications and variants.

Before describing the embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

Embodiments described here concern an apparatus for the production of metal, identified with reference number 10 in the attached drawings.

Figure 1:
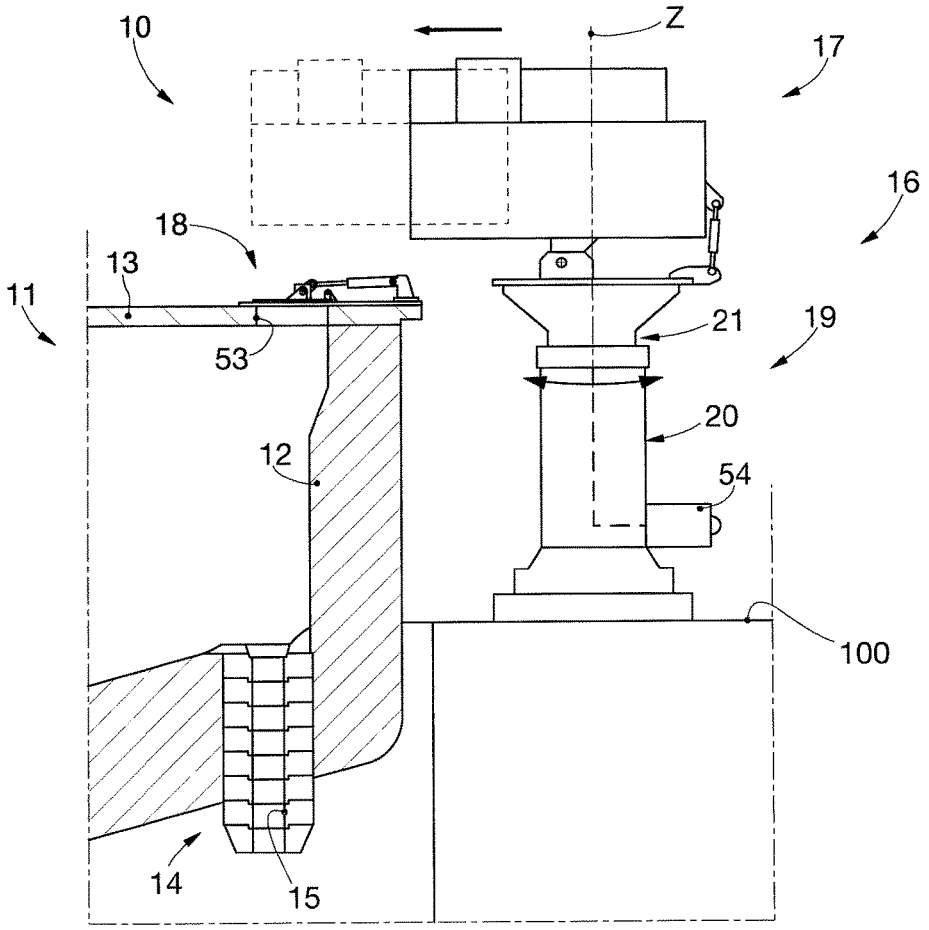
FIG. 1 is a partial lateral view of an apparatus for the production of metal in accordance with some embodiments.
Figure 2:
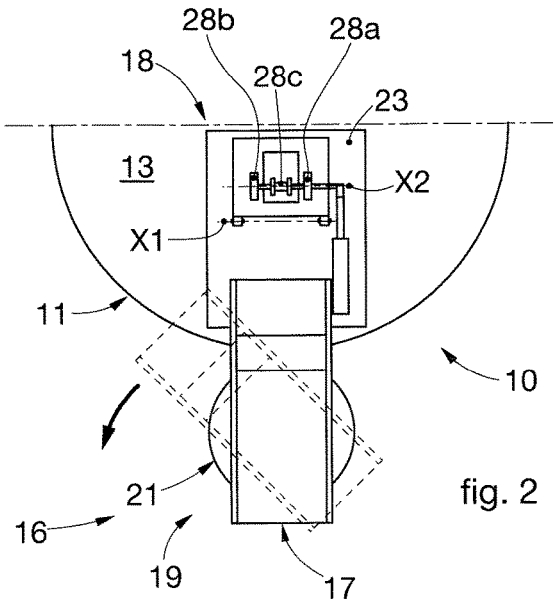
FIG. 2 is a top plan view of FIG. 1, wherein the delivery device is in the operative condition.
Figure 3:
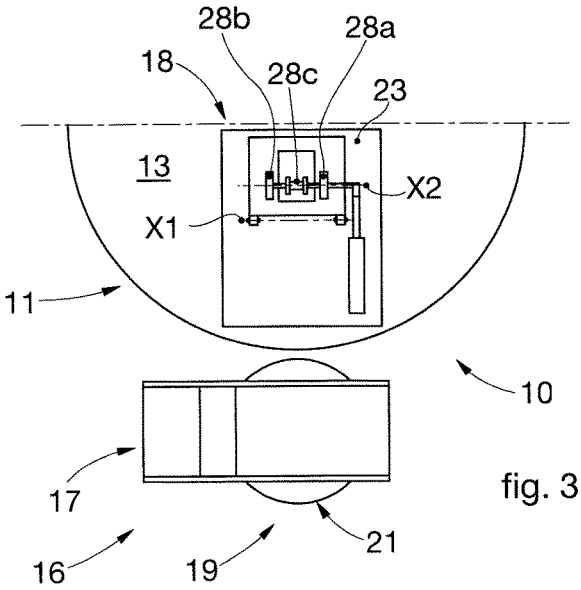
FIG. 3 is a top plan view of FIG. 1, wherein the delivery device is in the stand-by or parked condition.

In accordance with some embodiments, shown in FIGS. 1-3, an apparatus for the production of metal 10, hereafter apparatus 10, comprises a furnace 11 for melting metal provided with a containing receptacle, in this specific case a crucible 12, inside which a metal charge is melted.

The furnace 11 is provided with means 14 for tapping liquid metal disposed on the bottom of the crucible 12 and comprising a tapping channel 15 for the extraction of the liquid metal.

The furnace 11 is provided with a covering panel 13 disposed on the upper part of the crucible 12.

The apparatus 10 comprises a delivery unit 16 for the selective feed of inert material S into the tapping channel 15.

The delivery unit 16 comprises a delivery device 17 configured to selectively deliver a determinate quantity of the inert material S as above into the tapping channel 15 through a hatch unit 18 disposed on the covering panel 13 of the furnace 11.

The delivery unit 16 also comprises means 19 for supporting the delivery device 17.

The support means 19 comprise, in this specific case, a pedestal 20, stably attached to an installation surface 100 outside the furnace 11. The installation surface 100 can be, for example, that of the frame where the furnace 11 is installed and which allows the horizontal pivoting thereof for the tapping operations.

The support means 19 comprise a mobile base 21 stably attached to the pedestal 20 and configured to rotatably support the delivery device 17 in order to take it from an operative condition (FIGS. 1-2), in which it faces toward the furnace 11 and is aligned with the hatch unit 18, to a stand-by or parked condition, in which it is disposed outside the bulk of the furnace 11 (FIG. 3).

Since the delivery unit 16 is substantially independent of the furnace 11, since it is not constrained to it in any way whatsoever, it is possible to rotate the delivery device 17 in a stand-by or parked condition, for example in case it is necessary to carry out maintenance in the furnace 11, or if it is necessary to extract the furnace 11 with a bridge crane. Evidently, this is also advantageous in case it is necessary to carry out maintenance interventions on the delivery unit 16, since the operators can intervene safely by operating far from the furnace 11.

In accordance with some embodiments, the hatch unit 18 comprises a support plate 23, stably associated with the covering panel 13, and provided with an aperture 22 and a closing door 24, having the same size as that of the aperture 22 and configured to allow or prevent access to the aperture 22, for example in case it is necessary to carry out maintenance interventions.

The aperture 22 is aligned with a corresponding passage 53 defined on the covering panel 13, FIG. 1 and FIGS. 4-6.

The closing door 24 can comprise cooling devices 31, for example a coil of pipes inside which a cooling fluid can flow.

Figure 10:
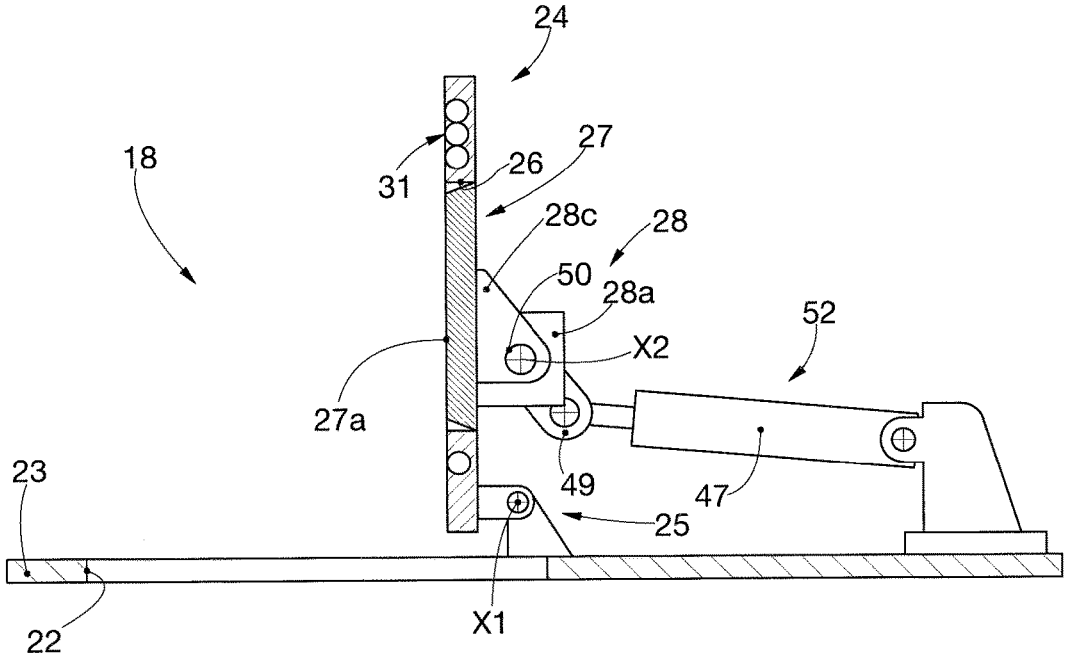
Figure 11:
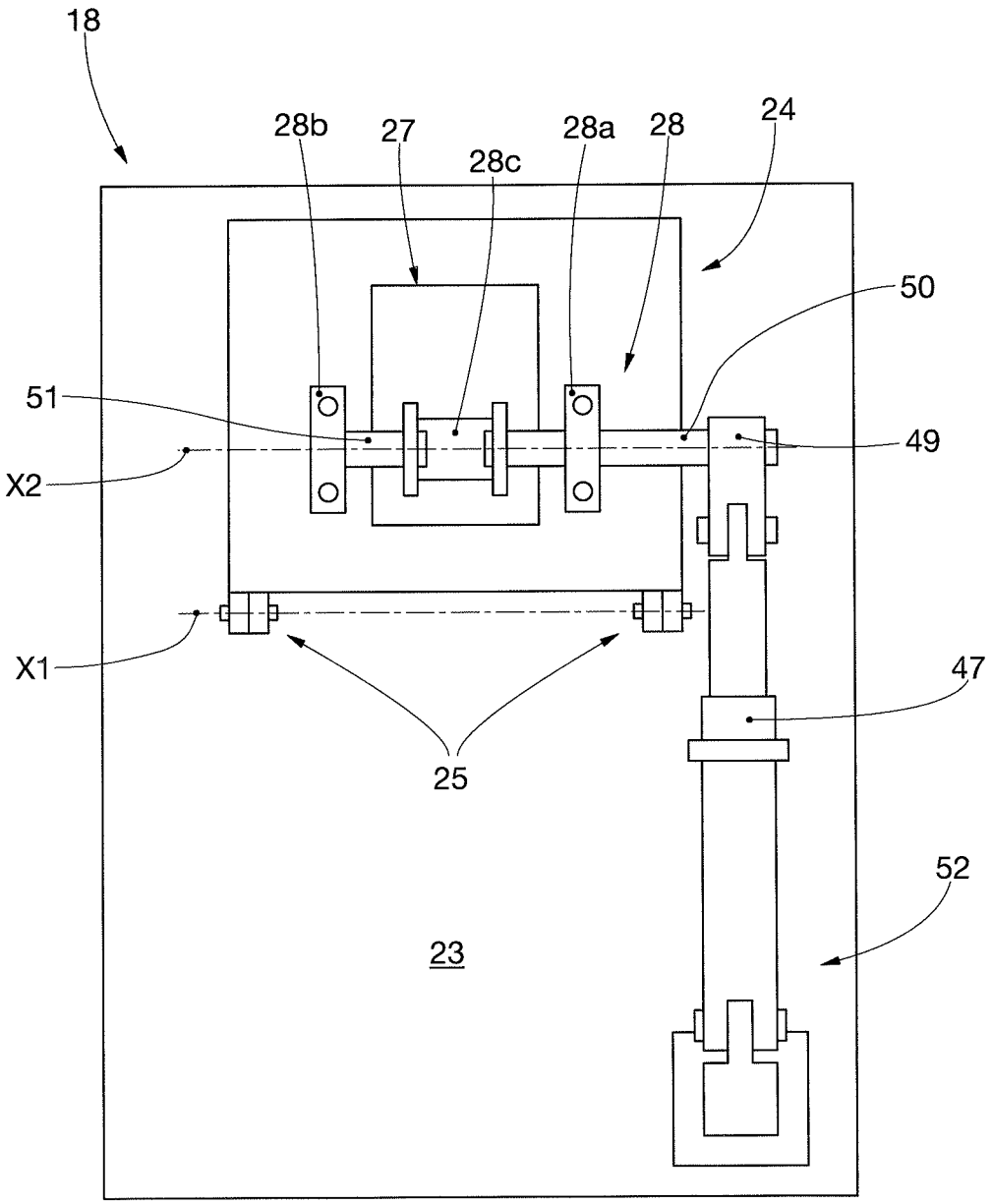
FIG. 11 shows a schematic top view of the hatch unit.

The hatch unit 18 comprises first pivoting means 25 and the closing door 24 is rotatably associated with the first pivoting means 25 in order to pass from an operative position, in which it prevents access to the aperture 22, to a maintenance position, shown in FIG. 10, in which it allows access to the aperture 22.

The first pivoting means 25 can be associated with the support plate 23.

The first pivoting means 25 can be disposed in correspondence with an end edge of the closing door 24.

The first pivoting means 25 are rotatable along a first axis of rotation X1 and are disposed in correspondence with the end edge of the closing door 24 closest to the delivery unit 16.

The closing door 24 is provided with a central aperture 26 and an access panel 27 configured to selectively open and close the central aperture 26, even only partly. The central aperture 26 is substantially vertically aligned with the tapping channel 15 located below, on the bottom of the crucible 12. Possibly, the central aperture 26 can be slightly offset with respect to the tapping channel 15, for example in the event the delivery of the inert material S does not occur in a perfectly vertical direction.

Figure 8:
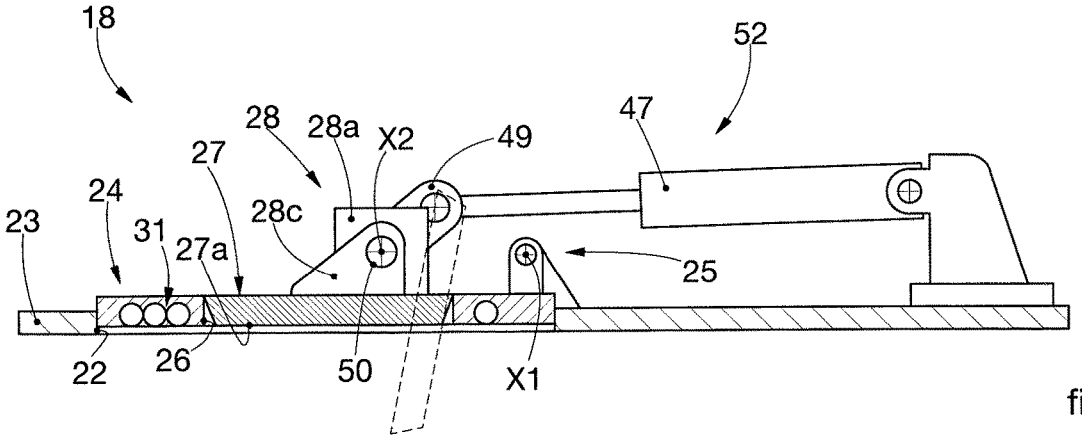
FIGS. 8-10 show a partly sectioned schematic lateral view of the hatch unit in which the components are represented in different operative positions.

The access panel 27 is configured to pass from a closed position, in which it is substantially parallel to the closing door 24 and prevents access to the central aperture 26, to an open position, shown with a dashed line in FIG. 8, in which it is inclined, for example it is orthogonal, with respect to the closing door 24, allowing access to the central aperture 26 for the introduction of the inert material S by the delivery device 17.

Figure 5:
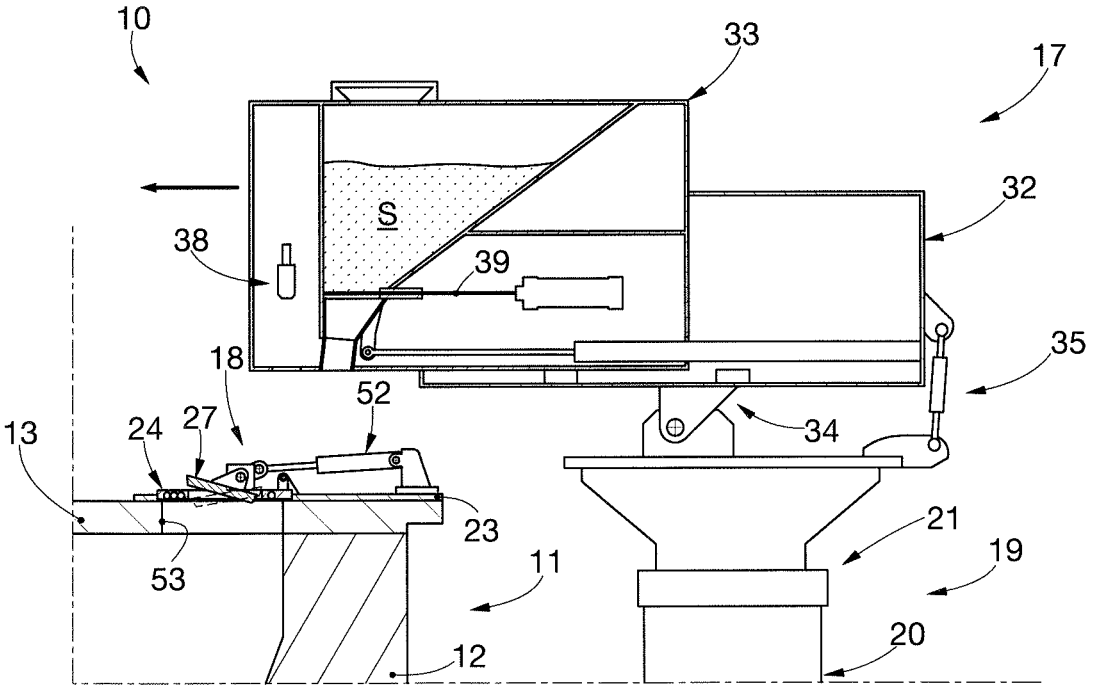
Figure 9:
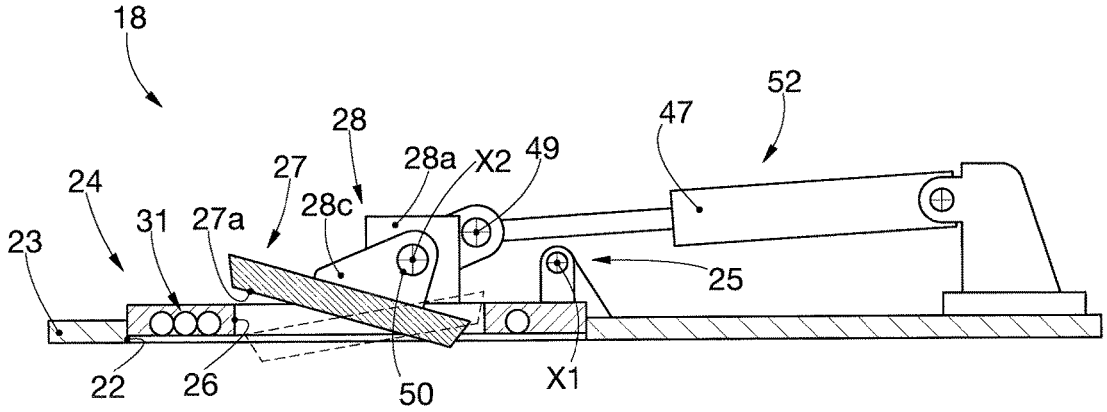

In accordance with the embodiment shown in FIG. 5 and FIG. 9, the access panel 27 is able to be inclined with respect to the closed position as above, both toward the inside and also toward the outside of the furnace 11, possibly in an alternate manner in order to break the layer of slag and metal that may have sedimented on an internal surface 27*a* of the access panel 27 during the operative steps of the furnace 11. For example, before carrying out the filling of the tapping channel 15, the access panel 27 can be inclined in an alternate manner toward the inside and toward the outside of the furnace 11 in order to break the layer of slag and metal as above, FIG. 5 and FIG. 9.

The hatch unit 18 comprises second pivoting means 28, and the access panel 27 is rotatably associated with the second pivoting means 28 in order to pass from the closed position as above to the open position as above, possibly through intermediate inclined positions, toward the inside and/or toward the outside of the furnace 11, FIGS. 8-9.

The second pivoting means 28 can be disposed in an intermediate position between the end edges of the access panel 27. In this way, when the access panel 27 passes from the closed position to the open position, it is possible to limit the vertical bulk of the access panel 27 and considerably reduce the force necessary to break the layer of slag and metal that forms on the internal surface 27*a*.

The second pivoting means 28 are rotatable along a second axis of rotation X2 substantially parallel to the first axis of rotation X1.

The second pivoting means 28 can comprise a pair of fixed peripheral elements, in this specific case a pair of bearings, 28*a*, 28*b* attached to the closing door 24 on one side and the other with respect to the central aperture 26, and a fixed central element, for example a lever or similar element, 28*c*, stably attached on the access panel 27, FIG. 1 and FIGS. 8-11.

The fixed peripheral element 28*a* and the central element 28*c* are associated with each other by means of a first pin 50. The fixed peripheral element 28*b* and the central element 28*c* are associated with each other by means of a second pin 51. The first pin 50 and the second pin 51 rotate about the second axis of rotation X2.

The hatch unit 18 can comprise an actuation assembly 52 for operatively controlling the movement of the closing door 24 and of the access panel 27.

The actuation assembly 52 can comprise first actuation means, configured to move the closing door 24, and second actuation means configured to move the access panel 27.

The first actuation means and the second actuation means can be attached to the support plate 23.

The first actuation means can be different and separated from the second actuation means.

In accordance with the embodiment shown in FIGS. 8-9, the actuation assembly 52 comprises, for example, an extendable arm 47 attached, with respect to a first end, to the support plate 23 and with respect to an opposite second end to a lever 49 associated with the second pivoting means 28. When the extendable arm 47 is driven, it allows the rotation of the lever 49 in order to move the access panel 27 from the closed position to the open position and vice versa, and to allow an alternate movement thereof in order to break the layer of slag and metal.

The lever 49 is pivoted, with respect to a first end, to the extendable arm 47 and with respect to an opposite second end to the first pin 50 for the transmission of motion to the access panel 27. The access panel 27 moves integrally with the lever 49, so that when the lever 49 makes the first pin 50 rotate, the access panel 27 rotates simultaneously.

In case it is necessary to move the closing door 24, the access panel 27 can be clamped with respect to the closing door 24 itself and allow the rigid rotation motion of the closing door 24 from the closed position to the maintenance position and vice versa.

Possibly, the movement of the closing door 24 can be operated by a loading and movement device, for example a bridge crane, which lifts the closing door 24 in rotation by means of hooks or lifting rings.

In accordance with some embodiments, at least the access panel 27 can be made of copper, or an alloy thereof. The high thermal conductivity of copper allows to optimally convey the heat produced in the furnace 11 during the operative steps of metal production. Possibly, the access panel 27 can also be provided with a cooling circuit in order to improve and speed up the heat exchange.

According to some embodiments, at least the internal surface 27*a* can be smooth, possibly polished, in order to limit as much as possible the possibility that the slag and the metal can stick on it.

In accordance with some embodiments, the delivery device 17 comprises a fixed support structure 32 configured to slidingly house a mobile storage and delivery structure 33.

The fixed support structure 32 is associated with the mobile base 21. In particular, the fixed support structure 32 is pivoted to the mobile base 21 so as to adjust the inclination of the delivery device 17 on a preferably vertical plane. This allows to direct the flow of inert material into the tapping channel 15 even with a curved trajectory, for example a parabolic one.

For this purpose, the fixed support structure 32 is hinged to the mobile base 21 on hinging means 34 disposed below the fixed support structure 32 in a substantially central position. Adjustment means 35, in this specific case a pair of arms, hydraulic or pneumatic, operatively connect the fixed support structure 32 with the mobile base 21 in order to allow the rotation of the delivery device 17 on the hinging means 34. The adjustment means 35 can be associated with a rear edge of the fixed support structure 32 and with a corresponding rear edge of the mobile base 21.

The mobile storage and delivery structure 33 comprises a storage cavity, or tank, 36 configured to contain the inert material S, delivery means 37 in selective communication with the storage cavity 36 and configured to introduce the inert material S through the central aperture 26, when the access panel 27 is in the open position, and control means 38 configured to verify the correct filling of the tapping channel 15 after the filling step thereof, or to verify the correct operative functionality thereof, after the step of tapping the melted metal.

The mobile storage and delivery structure 33 also comprises a mobile actuator 39 configured to allow or deny communication between the delivery means 37 and the storage cavity 36. The mobile actuator 39 is operatively commanded by a piston 40 disposed inside the mobile storage and delivery structure 33. The mobile actuator 39 allows to control the flow of inert material S in a precise and defined manner, in a continuous or discontinuous manner, that is, according to a filling curve which depends on the size of the tapping channel 15. The mobile actuator 39 can be, or comprise, for example a guillotine valve.

Figure 4:
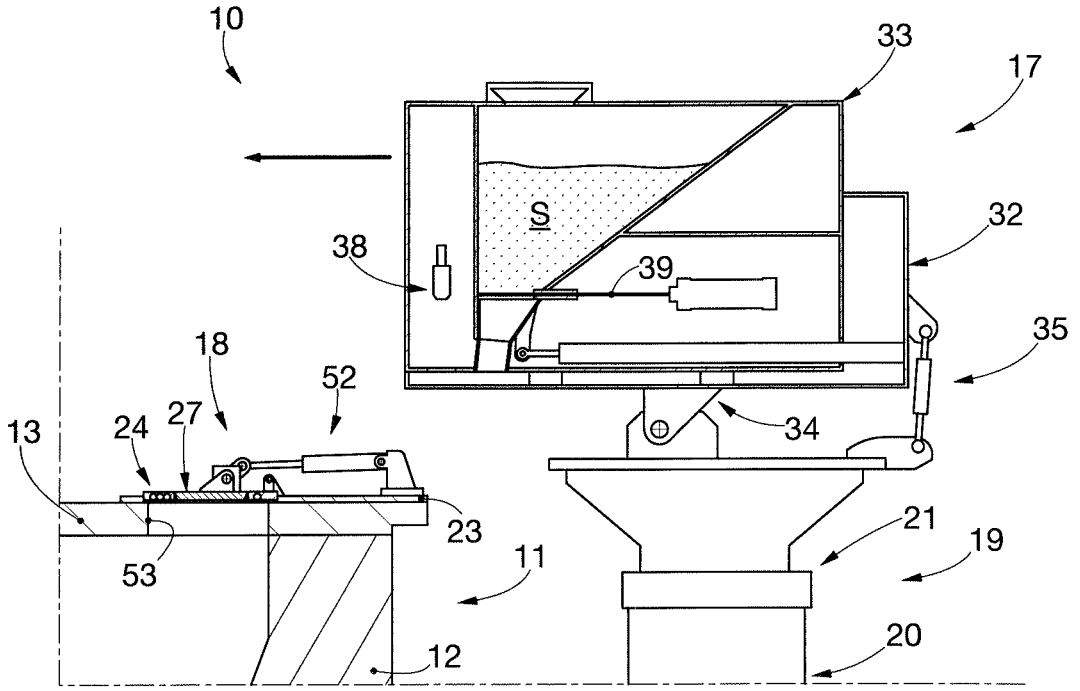
FIGS. 4-6 show a possible operative sequence of the apparatus for the production of metal of FIG. 1.
Figure 6:
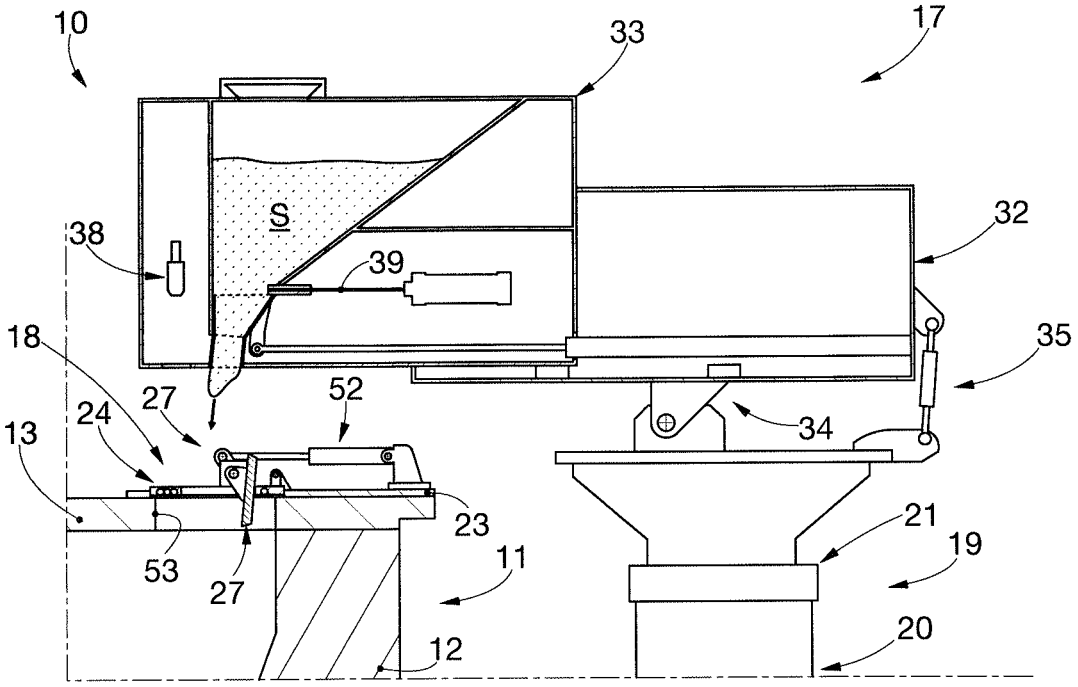

When the delivery device 17 is in the operative condition as above, the mobile storage and delivery structure 33 is mobile in order to pass from a retracted position, FIG. 4, in which the delivery means 37 are positioned far from the central aperture 26, to an extended or delivery position, FIG. 6, in which the delivery means 37 are positioned close to the central aperture 26, for example aligned, or almost aligned, with the central aperture 26 in order to deliver the inert material S, through it, into the tapping channel 15.

When the delivery device 17 is in the stand-by or parked condition as above, the mobile storage and delivery structure 33 can be moved from the retracted condition to the extended condition, for example in order to allow the storage cavity 36 to be resupplied with new inert material.

Figure 7:
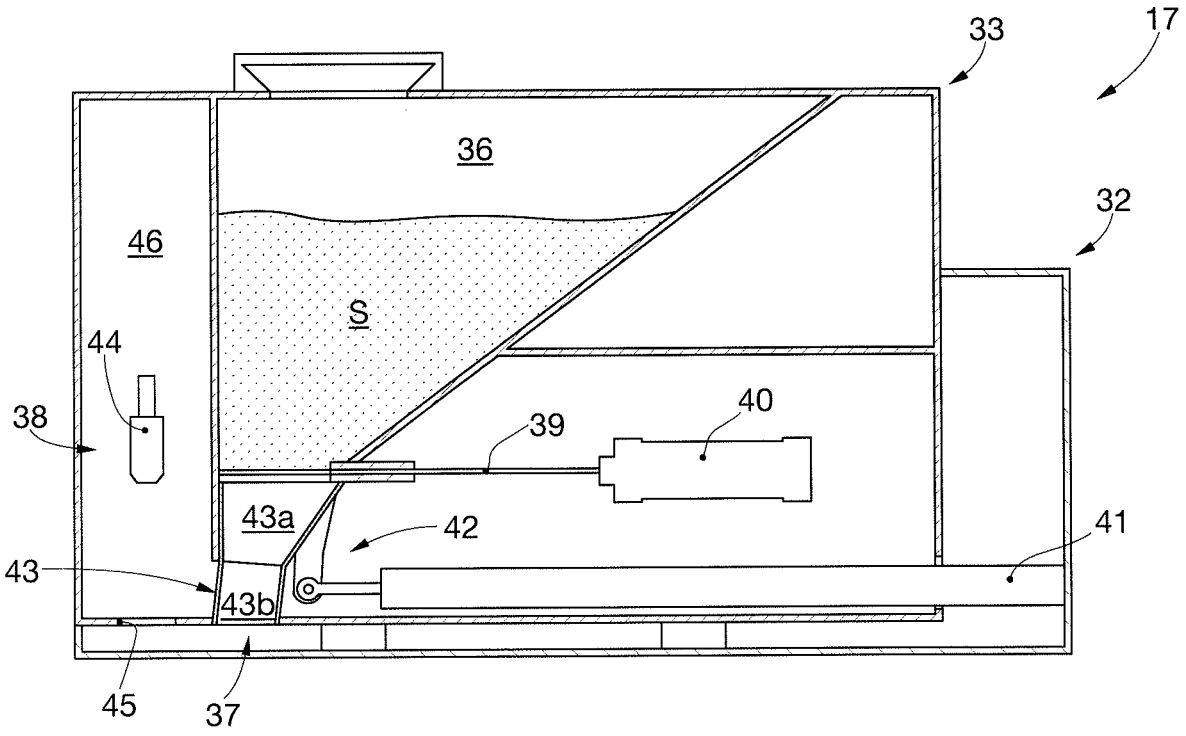
FIG. 7 shows a lateral section view of the delivery device.

The delivery device 17 comprises an actuator 41, electric, hydraulic or pneumatic, attached at the back to the fixed support structure 32 with respect to a first end, and at the front to the mobile storage and delivery structure 33 with respect to an opposite second end in correspondence with a connection joint 42, FIG. 7.

The delivery means 37 comprise a delivery channel 43 provided with an initial segment 43*a*, advantageously in the shape of a funnel, and a final segment 43*b* having a substantially constant section. Possibly, the delivery means 37 can be inclined in order to define the correct trajectory of the flow of inert material S.

In accordance with some embodiments, the control means 38 can comprise a video camera 44, or another suitable device, in a position that is fixed or that can be adjusted from remote, directed toward a control aperture 45 defined on the storage and delivery structure 33. The video camera 44 can be disposed in a housing compartment 46 defined at the front in the mobile storage and delivery structure 33.

At the end of the step of filling the tapping channel 15 with the inert material S and/or before it, the mobile storage and delivery structure 33 can be moved so as to align the video camera 44, and therefore the control aperture 45, with the central aperture 26, and therefore with the tapping channel 15. The video camera 44 can be used to visually inspect the tapping channel 15 even at different times during the filling cycle of the tapping channel 15 with the inert material S.

According to some embodiments, the mobile base 21 is rotatable along a vertical axis of rotation Z, FIG. 1, in order to take the delivery device from the operative condition to the stand-by or parked condition and vice versa, FIGS. 2-3.

The possibility of rotating the delivery device 17 into a position not interfering with the covering panel 13 allows to freely access it in case of need.

In a possible functioning variant of the apparatus 10, the rotation movement of the delivery device 17 (FIG. 2), possibly combined with the translation movement described above obtained by means of the actuator 41, allows to take the delivery device 17 into an appropriate position for loading the tank 36 by gravimetric fall, for example, from a storage hopper positioned above it through a tube and a valve.

For this purpose, the delivery unit 16 comprises a drive device 54 configured to activate/deactivate at least the movement of the mobile base 21, FIG. 1.

In the operative condition, the delivery device 17 is substantially aligned with the access panel 27, that is, with the central aperture 26. In this condition, the mobile storage and delivery structure 33 is mobile between the retracted or stand-by position and the extended or delivery position.

In accordance with some embodiments, a method is provided for the production of metal in the melting furnace 11 as above. The method comprises at least one step of filling the tapping channel 15 of the furnace 11 with the inert material S.

In accordance with one aspect of the present invention, the device 17 for delivering the inert material S is supported and moved in rotation by the support means 19, which are outside the furnace 11, at least from the stand-by or parked condition, in which the delivery device 17 is disposed outside the bulk of the furnace 11, to the operative condition, in which the delivery device 17 is cooperating with the tapping channel 15, and vice versa. In particular, in the operative condition, the delivery unit 17 is at least partly above the covering panel 13.

In accordance with some embodiments, when the delivery device 17 is in the operative condition as above, the mobile storage and delivery structure 33 is made to translate toward the hatch unit 18, in particular toward the access panel 27. At the same time, or just before, the method provides to move the access panel 27 in order to make available the access to the central aperture 26 from which the inert material S is discharged toward the tapping channel 15.

In accordance with some embodiments, the access panel 27 can be moved in rotation in an alternate manner, toward the inside and toward the outside of the furnace 11 in order to break the layer of slag and metal which may have sedimented on the internal surface 27*a* of the access panel 27.

In accordance with possible embodiments, the delivery device 17 can be moved in rotation into a loading condition, different from the operative condition and possibly also different from the stand-by or parked condition, in order to make the tank 36 available to be loaded/filled.

It is clear that modifications and/or additions of parts may be made to the apparatus for the production of metal as described heretofore, without departing from the field and scope of the present invention.

It is also clear that, although the present invention has been described with reference to some specific examples, a person of skill in the art shall certainly be able to achieve many other equivalent forms of an apparatus for the production of metal, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. A method to produce metal in a melting furnace, comprising at least one step of filling a tapping channel of a furnace for melting metal provided with a crucible inside which a metal charge is melted, and with a covering panel disposed on an upper part, said furnace being provided with means for tapping a liquid metal disposed on a bottom of said crucible and comprising the tapping channel for transferring said liquid metal from said furnace, wherein a delivery unit for delivering inert material (S) comprises a delivery device for selective delivery of the inert material (S) into said tapping channel, and a hatch unit is disposed on said covering panel and configured to allow access to the inside of said crucible for the delivery of said inert material (S), and wherein said delivery unit comprises support means configured to rotatably support said delivery device in order to take it from an operative condition, in which it faces toward said furnace and is aligned with said hatch unit, to a stand-by or parked condition in which it is disposed outside a bulk of the furnace, and vice versa, wherein the hatch unit comprises a support plate, stably attached to the covering panel, and provided with an aperture and a closing door, configured to allow or prevent access to the aperture, said closing door being provided with a central aperture and an access panel configured to selectively at least partially open and close the central aperture, and wherein the delivery unit is supported and moved in rotation by the support means outside said furnace, at least from the stand-by or parked condition, in which said delivery device is disposed outside the bulk of the furnace, to the operative condition, in which said delivery device is at least partly above the covering panel of the furnace being able to cooperate with said tapping channel, and vice versa.

2. The method as in claim 1, wherein when the delivery device is in said operative condition, a mobile storage and delivery structure of said delivery device is translated toward the access panel of said hatch unit, wherein simultaneously, or shortly before, the method provides to move the access panel in order to make available the central aperture of said access panel from which the inert material (S) is discharged toward the tapping channel.

3. The method as in claim 2, wherein before making said central aperture available, said access panel is moved in rotation in an alternating manner, toward the inside and toward the outside of the furnace in order to break a layer of slag and metal that has settled on an internal surface of said access panel.

4. The method as in claim 1, wherein when it is necessary to fill a tank of said delivery device, said delivery device is moved in rotation into a loading condition, different from the operative condition.

5. An apparatus for the production of metal comprising:

a furnace for melting metal provided with a crucible inside which a metal charge is melted, and with a covering panel disposed on an upper part, said furnace being provided with means for tapping a liquid metal disposed on a bottom of said crucible and comprising a tapping channel for transferring said liquid metal from the furnace, a unit for delivering inert material (S) comprising a delivery device for selective delivery of the inert material (S) into said tapping channel, a hatch unit disposed on said covering panel and configured to allow access to the inside of said crucible for the delivery of said inert material (S), wherein said delivery unit comprises support means configured to rotatably support said delivery device in order to take it from an operative condition, in which it faces toward said furnace and is aligned with said hatch unit, to a stand-by or parked condition in which it is disposed outside a bulk of the furnace, and vice versa, wherein the hatch unit comprises a support plate, stably attached to the covering panel, and provided with an aperture and a closing door, configured to allow or prevent access to the aperture, said closing door being provided with a central aperture and an access panel configured to selectively at least partially open and close the central aperture.

6. The apparatus as in claim 5, wherein said support means comprise a pedestal, stably attached to an installation surface outside said furnace, and a mobile base stably attached to said pedestal and configured to take said delivery device from said operative condition to said stand-by or parked condition and vice versa.

7. An apparatus for the production of metal comprising:

a furnace for melting metal provided with a crucible inside which a metal charge is melted, and with a covering panel disposed on an upper part, said furnace being provided with means for tapping a liquid metal disposed on a bottom of said crucible and comprising a tapping channel for transferring said liquid metal from the furnace, a unit for delivering inert material (S) comprising a delivery device for selective delivery of the inert material (S) into said tapping channel, a hatch unit disposed on said covering panel and configured to allow access to the inside of said crucible for the delivery of said inert material (S), wherein said delivery unit comprises support means configured to rotatably support said delivery device in order to take it from an operative condition, in which it faces toward said furnace and is aligned with said hatch unit, to a stand-by or parked condition in which it is disposed outside a bulk of the furnace, and vice versa, wherein the hatch unit comprises a support plate, stably attached to the covering panel, and provided with an aperture and a closing door, configured to allow or prevent access to the aperture, said closing door being provided with a central aperture and an access panel configured to selectively at least partially open and close the central aperture, wherein the access panel is configured to pass from a closed position, in which it is substantially parallel to the closing door and prevents access to the central aperture, to an open position, in which it is inclined with respect to the closing door allowing access to the central aperture for the introduction of the inert material (S) by the delivery device.

8. The apparatus as in claim 7, wherein the access panel is able to be inclined with respect to said closed position, both toward the inside and toward the outside of the furnace, possibly in an alternate manner.

9. The apparatus as in claim 5, wherein the hatch unit comprises second pivoting means and the access panel is rotatably associated with the second pivoting means to pass from said closed position to said open position.

10. The apparatus as in claim 9, wherein the second pivoting means comprise a pair of fixed peripheral elements attached to the closing door on one side and on the other with respect to said central aperture, and a fixed central element, attached to said access panel, said fixed peripheral element and said central element being associated with each other by means of a first pin, said fixed peripheral element and said central element being associated with each other by means of a second pin, distinct from said first pin.

11. The apparatus as in claim 5, said hatch unit comprises an actuation assembly in order to operatively control movement of the closing door and of the access panel.

12. The apparatus as in claim 10, wherein said actuation assembly comprises an extendable arm and a lever, said extendable arm being attached with respect to a first end to the support plate, and with respect to an opposite second end to said lever, said lever being associated with said second pivoting means in order to move at least said access panel.

13. The apparatus as in claim 6, wherein the delivery device comprises a fixed support structure configured to slidably house a mobile storage and delivery structure, said fixed support structure being pivoted to the mobile base so as to adjust an inclination of the delivery device on a vertical plane.

* * * * *